US005934290A

United States Patent [19]

Carroll et al.

[11] Patent Number: 5,934,290

[45] Date of Patent: Aug. 10, 1999

[54] METHODS, APPARATUS AND KITS FOR FORMING ARTIFICIAL FINGERNAILS

[76] Inventors: George H. Carroll, 853 Via Alondra, Camarillo, Calif. 93010; Arthur A. Krause, 20642 Skouras Dr., Canoga Park, Calif. 91306

[21] Appl. No.: 08/771,474

[22] Filed: Dec. 23, 1996

[51] Int. Cl.[6] ..... A45D 29/00

[52] U.S. Cl. ..... 132/73; 132/285; 132/200; 132/73.5

[58] Field of Search ..... 132/73, 73.5, 75.3, 132/75.4, 75.6, 200, 285, 319, 320, 333

[56] References Cited

U.S. PATENT DOCUMENTS

| | | | |
|---|---|---|---|
| 1,289,952 | 12/1918 | Struble | 132/73 |
| 2,162,155 | 6/1939 | Calvin | 132/73 |
| 2,816,555 | 12/1957 | Klump | 132/73 |
| 3,982,551 | 9/1976 | Bartolucci | 132/73 |
| 4,596,260 | 6/1986 | Giuliano | 132/73 |
| 4,947,876 | 8/1990 | Larsen | 132/285 |
| 5,005,595 | 4/1991 | Aylott | 132/73 |
| 5,127,414 | 7/1992 | Mast et al. | 132/73 |

*Primary Examiner*—Gene Mancene
*Assistant Examiner*—Pedro Philogene
*Attorney, Agent, or Firm*—Page Lohr Associates

[57] ABSTRACT

Systems of the invention for forming artificial fingernails include methods, apparatus and kits. A form implement is fashioned into a complementary shape of a fingernail. Acrylic material in a gelatinous state, applied to a base comprised of a natural fingernail and optionally an artificial fingernail tip, is molded by further application of a form. A form of the invention tends to shape the acrylic material in a preferred manner before it hardens in the polymerization process. The form, left in intimate contact with the hardening acrylic material, imparts its shape and texture to the material. A form, thereafter having been removed from a newly created artificial fingernail, creates a superior looking nail having a smooth transparent look which is more natural and desirable. In addition, forms of the invention result in better shaped nails having less defects than nails formed via commonly known techniques.

20 Claims, 12 Drawing Sheets

METHODS, APPARATUS AND KITS FOR FORMING ARTIFICIAL FINGERNAILS

BACKGROUND OF THE INVENTION

1. Field

This invention disclosure is generally concerned with cosmetic artificial fingernails and specifically concerned with acrylic artificial fingernails which are formed with the aid of devices and techniques which include use of a form implement.

2. Prior Art

Acrylic artificial fingernails are attractive cosmetic articles which are quite popular among woman users of all ages. Approximately 200,000 salons across America offer services to create and maintain acrylic fingernails. These salons are staffed by skilled artisans having expertise required to provide beautiful artificial nails to their clients. Accordingly, considerable sums of money are spent in pursuit of durable, high quality artificial fingernails.

It is sometimes desirable to ignore the salon and to create artificial nails in a home environment. Indeed, it is possible for one to purchase kits from common drugstores which contain the necessary materials. Typically, a kit may include a monomer acrylic material in powder form, a liquid activator, artificial nail tips, mixing facilities, application materials such as a brush, and shaping aids which may include a file. A mixture of liquid and powder is subject to a chemical polymerization reaction. The mixture in a gelatinous state may be applied to a base which is comprised of a natural fingernail and artificial nail tip which may be affixed to the natural nail. A brush can be used to push the gelatinous material about the base surface in attempt to form an evenly distributed layer in a desired shape which simulates a natural nail. Great skill and care is required to form a perfect nail which takes a natural shape. After a short time, the gelatinous acrylic sets and hardens in a shape formed by applying the material in this fashion. As the polymerization reaction advances, the acrylic becomes quite hard and finally results in a durable solid material. Soon after hardening has occurred, the nail may be further shaped and dressed by filing, buffing and polishing.

Acrylic material which is allowed to cure with its top surface exposed to air tends to form a surface which is relatively coarse on a macroscopic scale; i.e. it is slightly coarse to the touch. The resulting surface appears translucent and may appear white in color. Since a natural nail appears quite smooth and a bit transparent on its surface, it is desirable to perfect the artificial nail by buffing its surface to resemble the natural nail. This may be accomplished by rubbing the surface of a newly formed acrylic nail with emery board and buffing agents. As acrylic material is naturally quite hard, it takes considerable effort and time to properly shape, buff and smooth the artificial nail.

There are still further problems which tend to want solutions. Persons attempting to form fingernails onto their own hands are faced with the problem that one hand may work preferably better than the other. For example, a right-handed person may easily be able to apply nails to the left hand as the motor coordination of the right hand is quite good for detailed or fine work. However, it may be prohibitively difficult for the left hand to apply nails to the right hand fingertips. For most persons, it is prohibitively difficult to create fingernails with their left hand. Without a means of simplifying the process of forming artificial nails, one must submit to the expense of professionally prepared nails.

Notwithstanding, techniques have been discovered which provide very novel systems for the application and formation of acrylic artificial fingernails. The invention easily allows one to apply fingernails to oneself as it simplifies the process in a manner which obviates the problems mentioned above. In addition, the invention provides great advantage to salon professionals as it tends to greatly reduce time and effort which must be expended to realize great looking fingernails.

SUMMARY OF THE INVENTION

Comes now, Arthur A. Krause and George H. Carroll with an invention including methods, apparatus, and kits of forming artificial fingernails. It is a primary function of the invention to provide systems which simplify the process of forming acrylic fingernails. It is a contrast to prior art methods and devices that these new systems do not require tedious shaping and buffing steps which tend to require skill and excessive amounts of time. A fundamental difference between methods, apparatus and kits of the instant invention and those of the art can be found when considering its special nail shaping forms or molding implements and their use. Systems of the art do not provide such. In accordance with the invention, an acrylic material may be applied to a fingernail and fingernail tip in the conventional way. However, before the acrylic polymerization reaction is allowed to advance to the point where the gel becomes hardened, a form is applied to the top surface of the gel acrylic material. Slight pressure may additionally be applied. The pressure urges the acrylic material to spread evenly into a uniform layer. Still further, the acrylic tends to take the shape of the form as defined by its bottom surface. An important aspect of this results in a surprising effect. A form having a smooth surface will impart and transfer that smoothness to the surface of the acrylic when it is cured.

After appropriate amount of time has past to allow the acrylic to harden, the form may be removed from the newly formed artificial nail. The resulting nail has superior shape and surface qualities. Further dressing may include only minor applications of filing or buffing. The nail surface may be in proper condition to immediately receive thereon nail polish in the conventional way.

The addition of applying a form to a curing acrylic material used in the formation of artificial fingernails reduces the skill and time required to create beautiful nails.

OBJECTIVES OF THE INVENTION

It is an object of the invention to provide systems for forming artificial fingernails.

It is additionally an object of the invention to provide methods of forming artificial fingernails via a form implement.

It is an object of the invention to provide apparatus for forming fingernails, the apparatus including a form.

It is also an object of the invention to provide kits of material and apparatus for forming artificial fingernails.

A better understanding can be had with reference to the detailed description of Preferred Embodiments and with reference to the appended drawings. These embodiments represent particular ways to realize the invention and are not inclusive of all ways possible. Therefore, embodiments may exist that do not deviate from the spirit and scope of this disclosure as set forth by the claims, but do not appear here as specific examples. It will be appreciated that a great plurality of alternative versions are possible.

BRIEF DESCRIPTION OF THE DRAWING FIGURES

These and other features, aspects, and advantages of the present invention will become better understood with regard to the following description, appended claims and drawings where:

Figure 6:
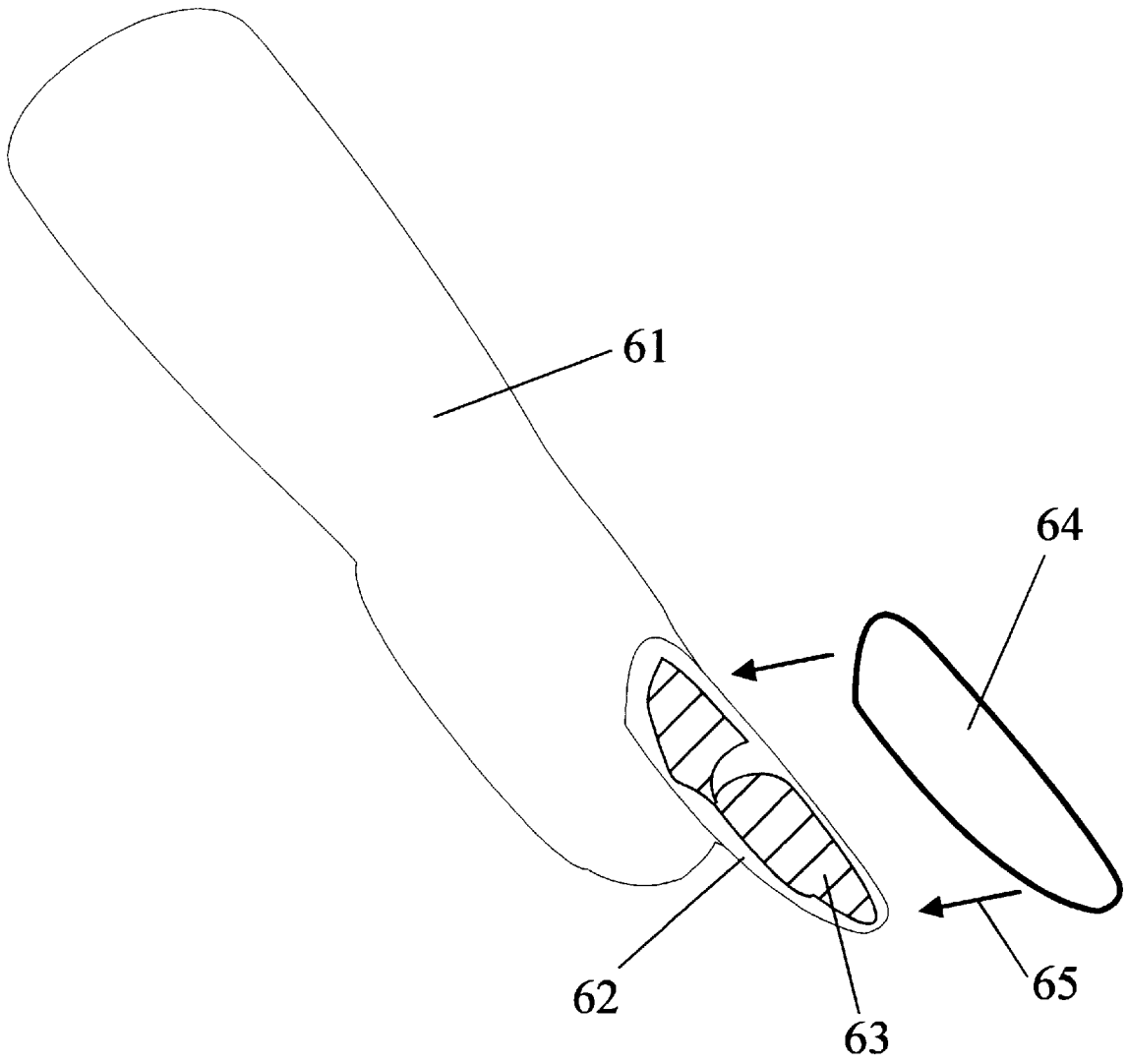
Figure 7:
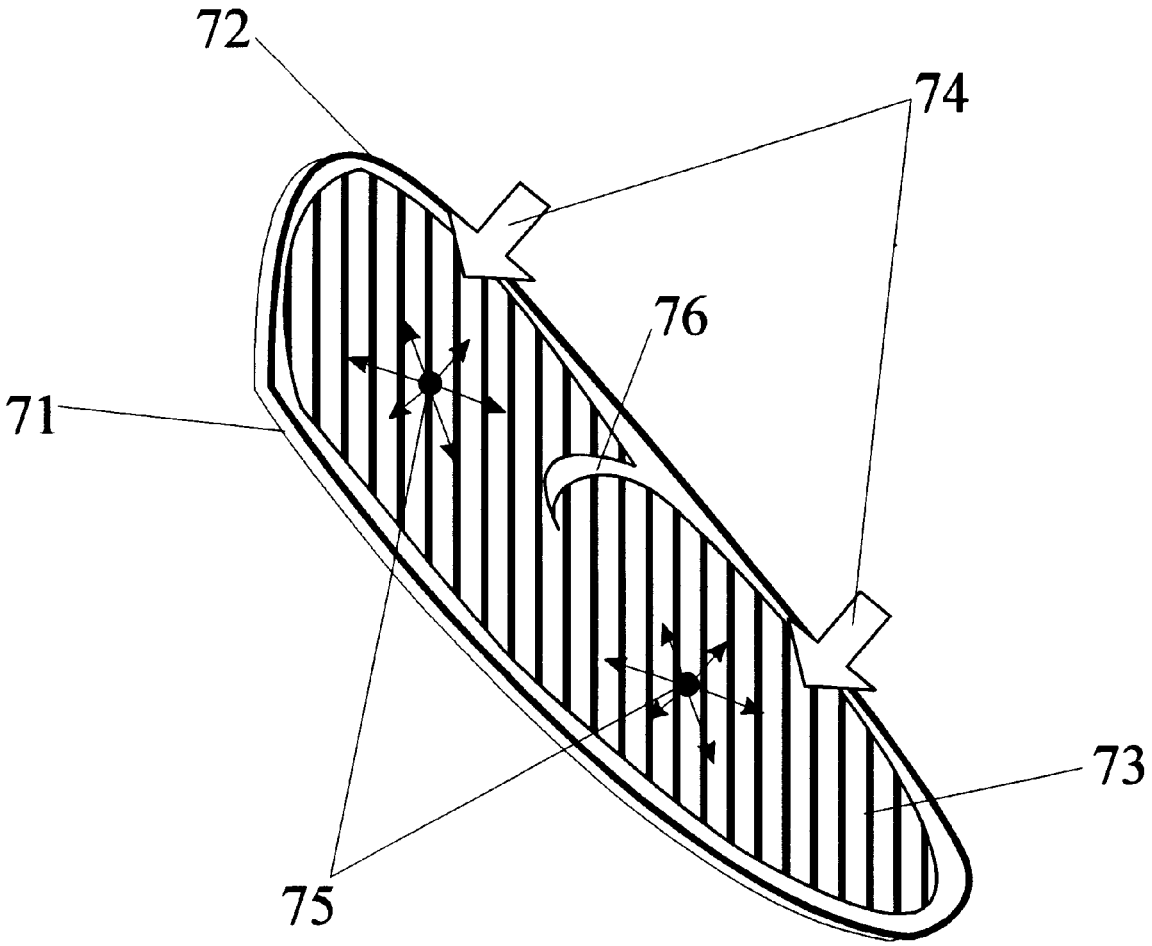
Figure 8:
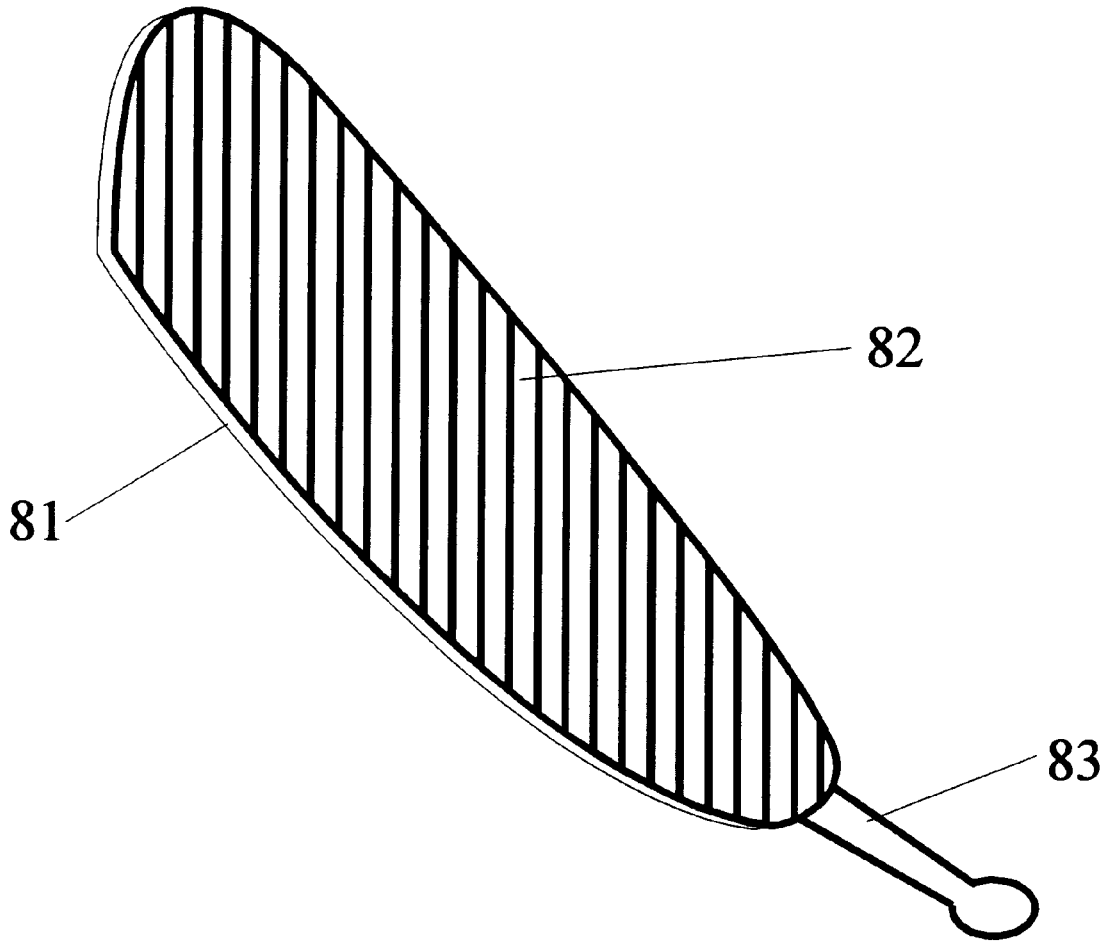
Figure 9:
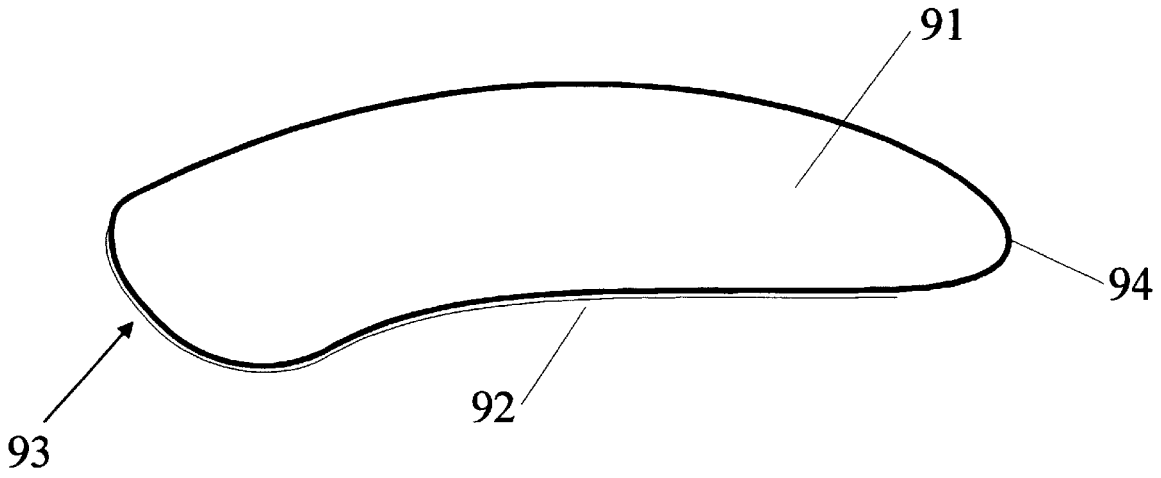
Figure 10:
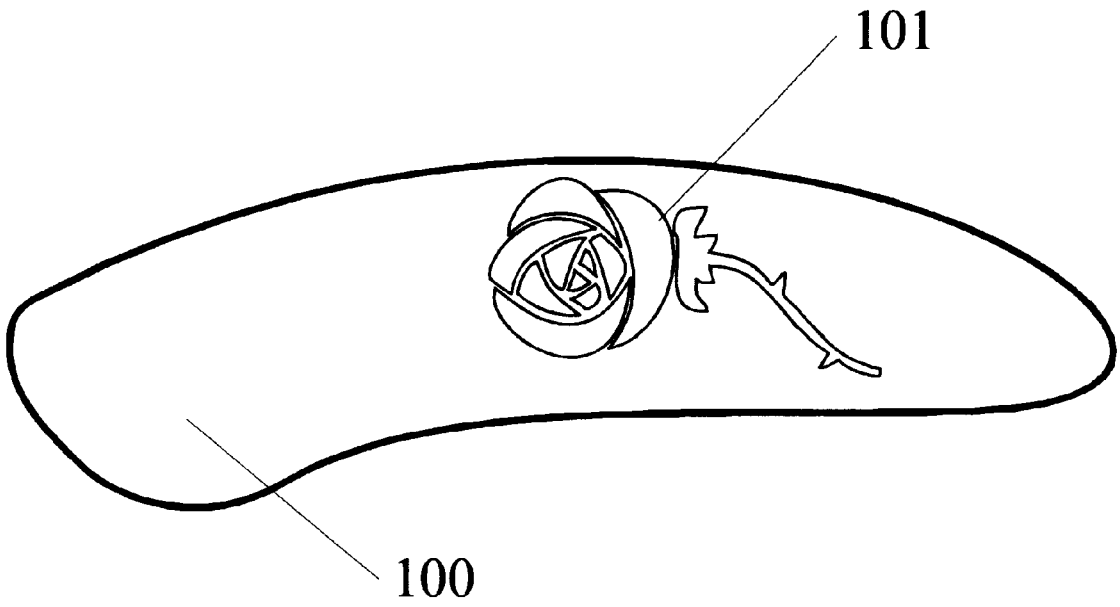
Figure 11:
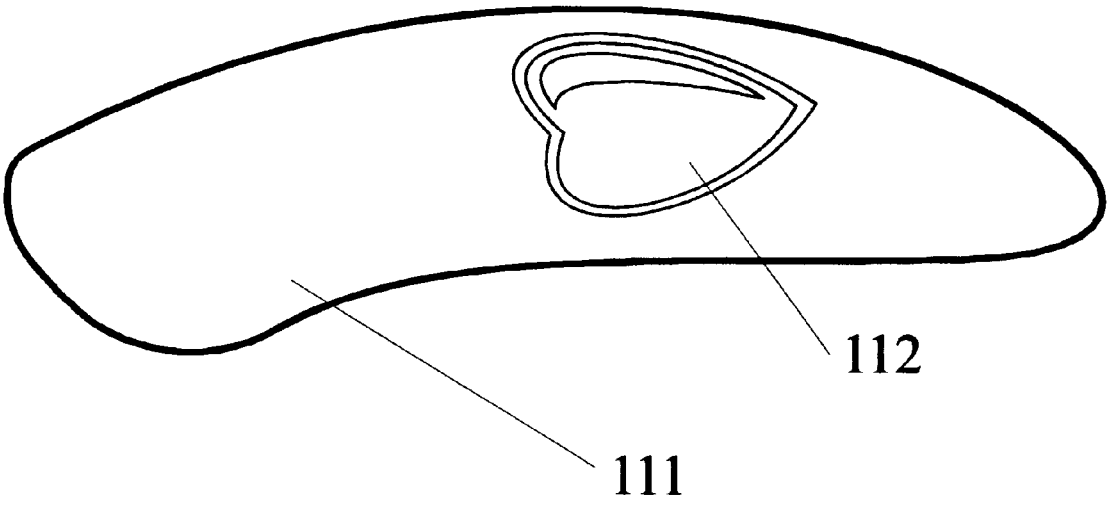

FIG. 6 a nail and nail tip having acrylic gel thereon; and additionally, a nail form which is to be applied to thereto;

FIG. 7 illustrates how pressure applied to the form tends to encourage the acrylic gel to spread uniformly about the top surface of the nail and nail tip;

FIG. 8 shows a very uniform layer created with a nail form of the invention;

FIG. 9 shows a close-up view of a nail form having a special edge;

FIG. 10 is a drawing of an alternative version of the invention which includes a fanciful design pattern;

FIG. 11 similarly shows a version with a different design; and

Figure 12:
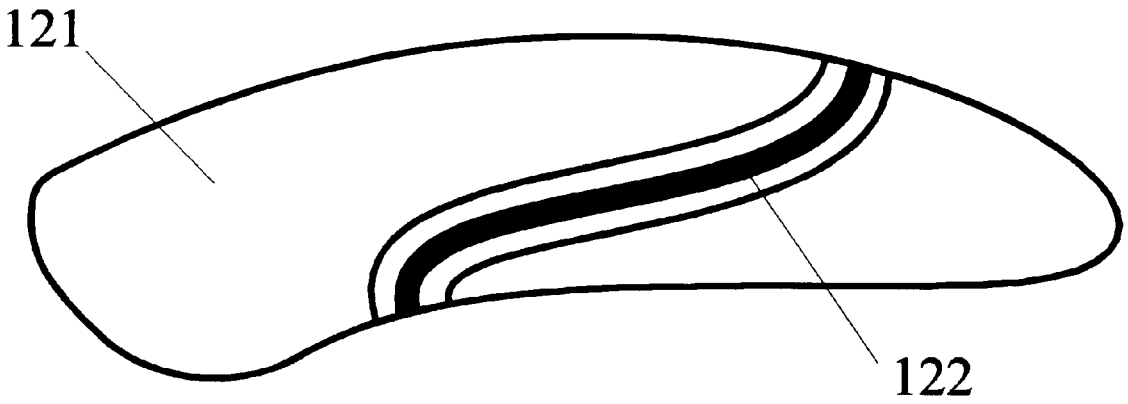

FIG. 12 shows a version with still further another design.

PREFERRED EMBODIMENTS OF THE INVENTION

In accordance with each of the preferred embodiments of the invention, there is provided methods, apparatus and kits for forming artificial fingernails. It will be appreciated that the embodiments described include each a method, apparatus and kit; and that the method, apparatus and kit of one preferred embodiment may be different than the method, apparatus and kit of another embodiment.

Figure 1:
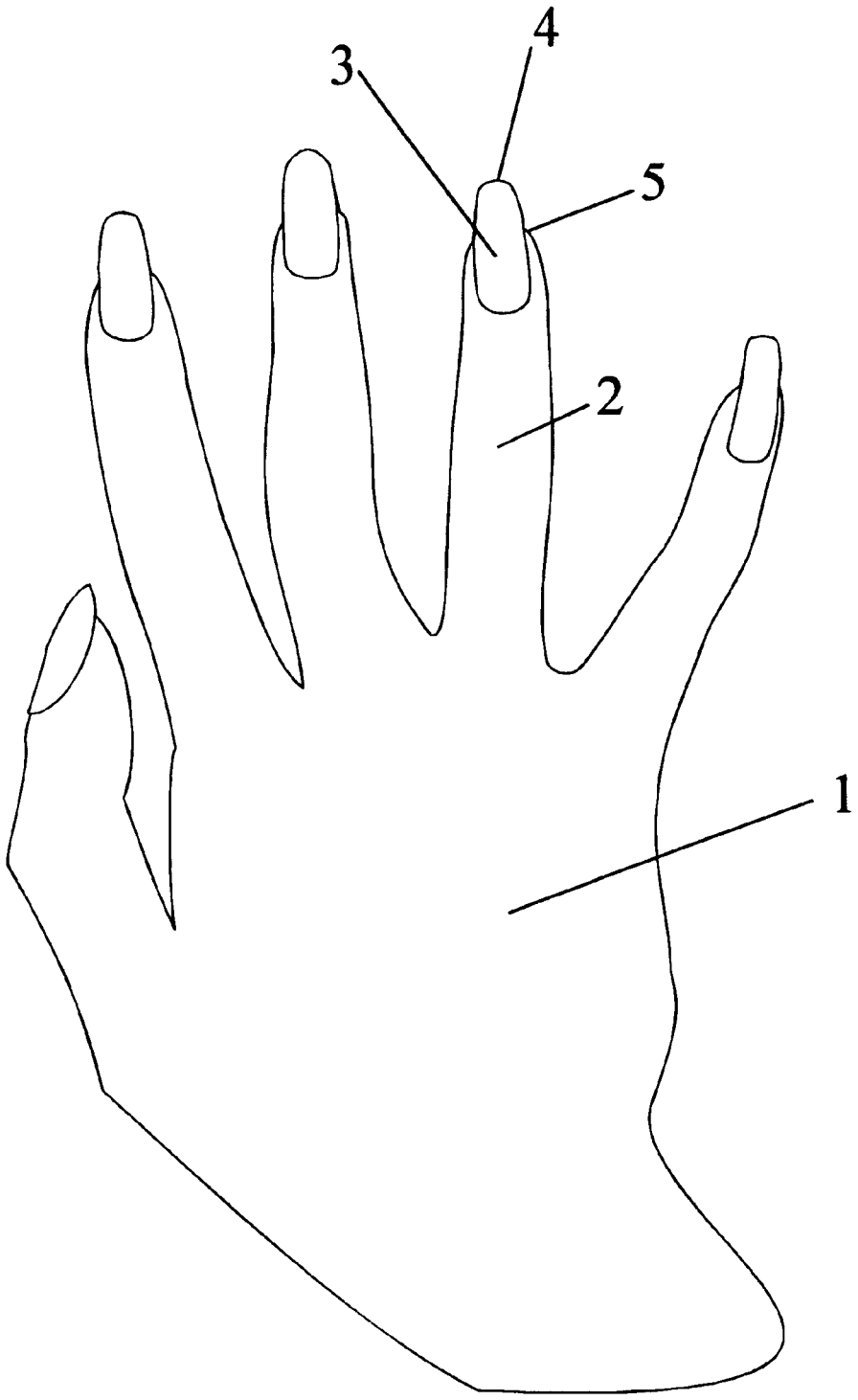
FIG. 1 is drawing showing an attractive look for cosmetic fingernails.
Figure 2:
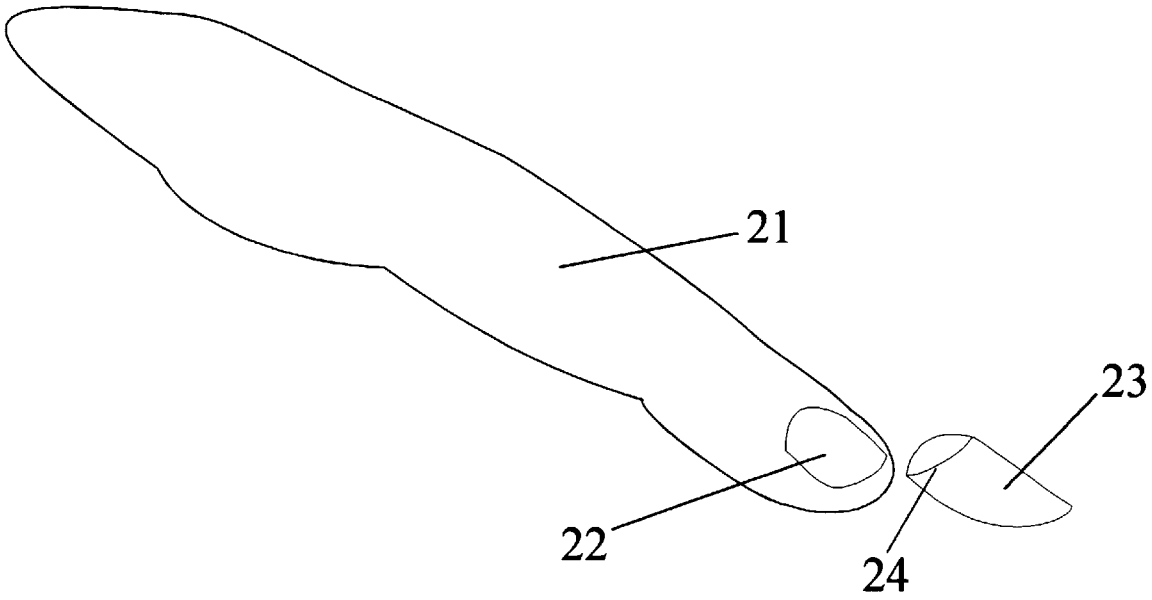
FIG. 2 shows a nail tip which may be affixed to a natural nail to form a base onto which acrylic may be applied.

With reference to the drawing figures, in particular FIG. 1, a hand 1 is shown where long fingers 2 are made more beautiful with elegantly formed fingernails 3. Typically, the end of a fingernail 4 extends far past the end of the finger 5. Since it may be difficult to have natural fingernails which extend past ones fingertips, cosmetic nail products sometimes include a finger tip device which may be glued to the tip of a natural fingernail. FIG. 2 shows a single finger 21 with a small natural nail 22. An artificial nail tip 23 may be formed of a white plastic material. The nail tip takes the shape of a finished nail and may be provided in various desired lengths which tend to change with fashion trends and personal preferences. A nail tip may include on its underside a ridge 24 (shown from the top in the figure through the translucent material) which is intended to engage and matingly receive the natural nail at a portion of its periphery. A nail tip, securely fastened to a natural nail, forms a base upon which an acrylic material may be applied.

Figure 3:
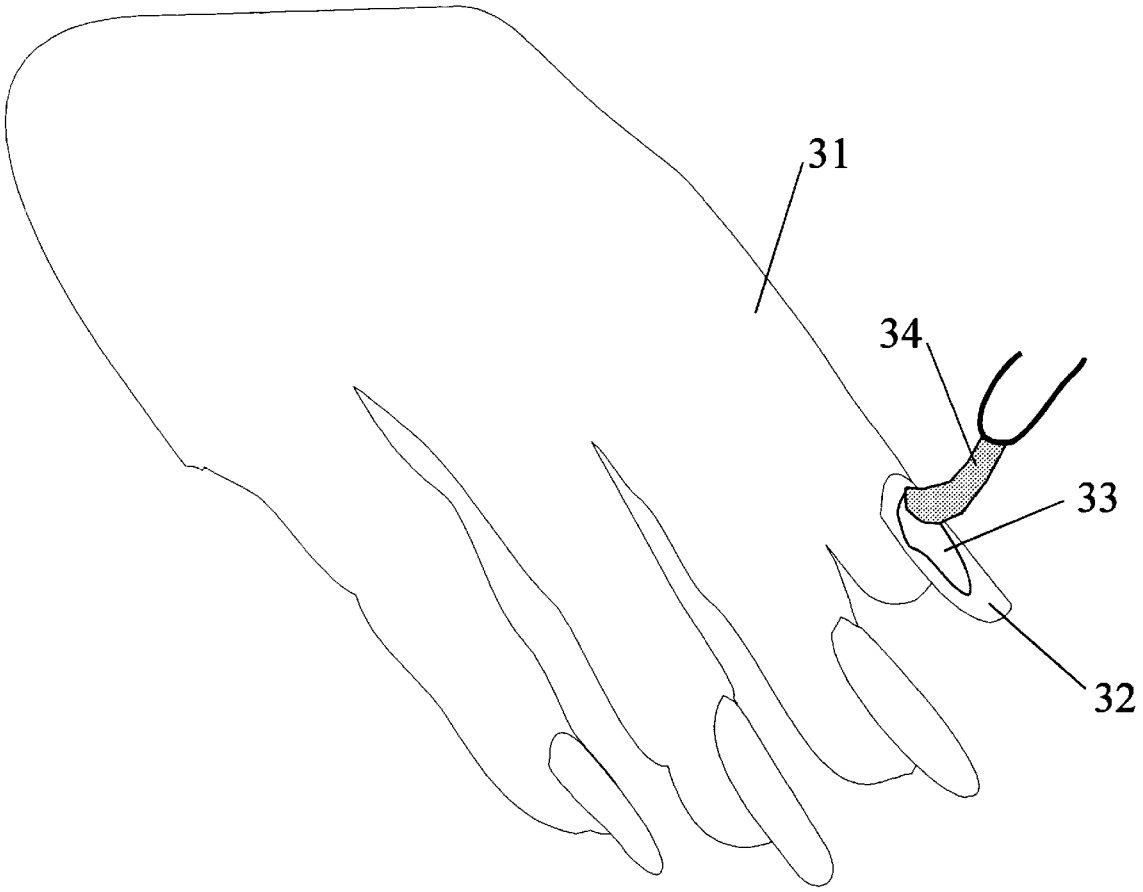
FIG. 3 illustrates application of acrylic gel material to the top surface of a nail and nail tip base.
Figure 4:
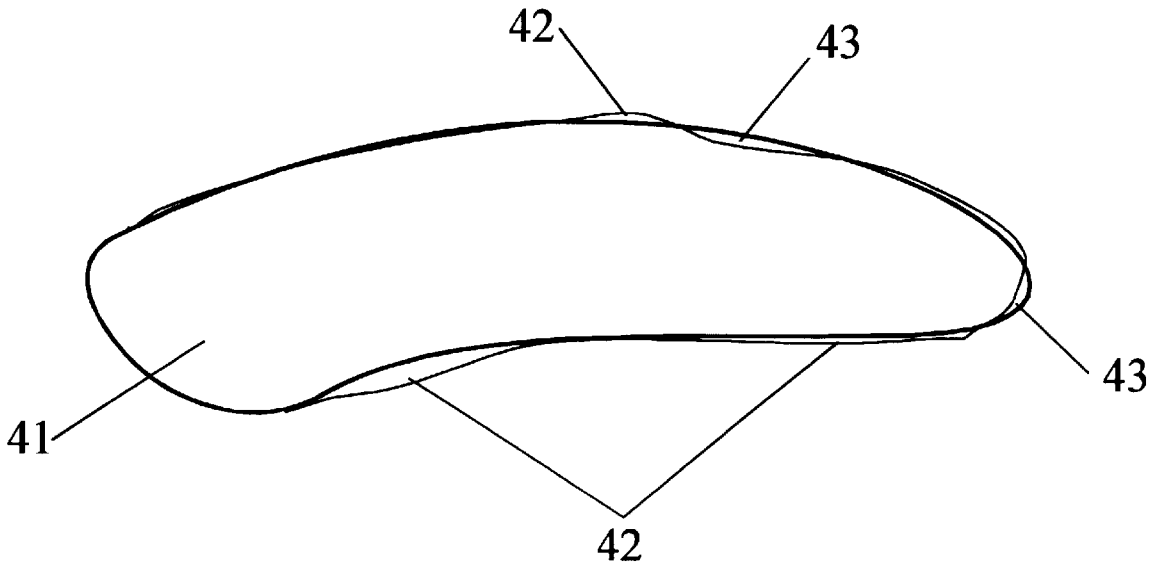
Figure 4 (Prior Art)
FIG. 4 is a prior art drawing which shows how acrylic material tends to set in a non-uniform fashion with respect to the nail and nail tip onto which it is brushed.

Acrylic material is commonly used for forming artificial fingernails. A two part mixture may be fluid or in a gel state for a brief time before becoming very hard and solid. In the gel state, acrylic may be applied to the top surface of a nail and nail tip combination which forms a base. FIG. 3 illustrates a finger 31 having a nail and nail tip combination 32 to which acrylic material 33 is being smoothed on with a brush 34. With great care, one attempts to spread the acrylic evenly to form a uniform layer on the base. The brush pushes the material about and may be used to direct any flowing of the gel. As the material hardens from a gel state to a solid state, the brush becomes ineffective for further spreading the acrylic. Invariably, some of the material hardens in places where it is not desired. Sometimes portions of the nail are to thick while other portions are left too thin. Additionally, the material may exceed the peripheral boundaries of the nail and nail tip. Alternatively, the material may not fully cover the peripheral boundaries thereby leaving voids. FIG. 4 shows a nail and nail tip 41 having acrylic material hardened thereon. Regions indicated by numeral 42 indicate that acrylic material has exceeded the periphery. Similarly, regions indicated by numeral 43 are where voids of material exists. Although voids are not easily repaired, excess material can be removed by filing.

Figure 5:
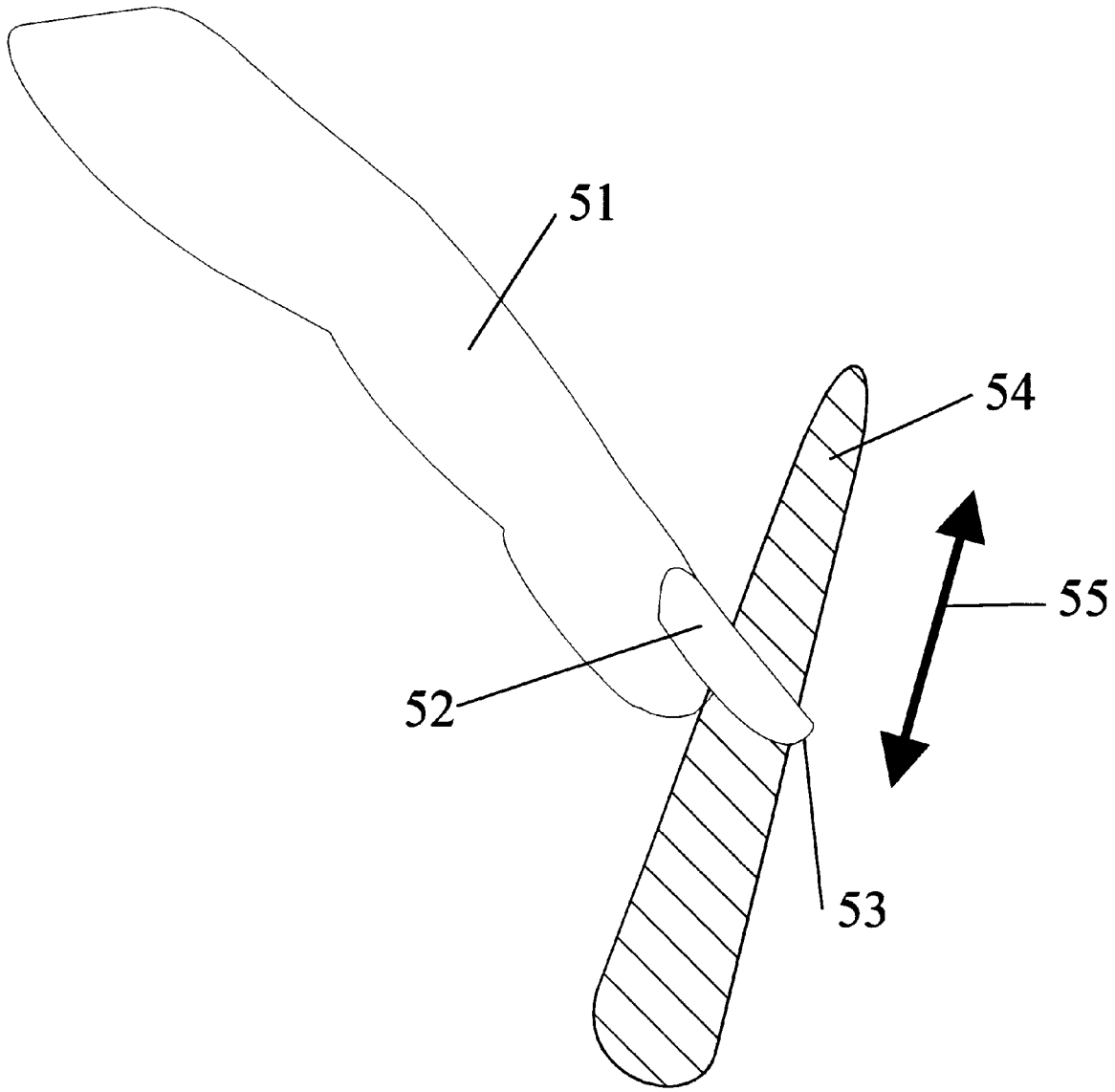
Figure 5 (Prior Art)
FIG. 5 is a prior art drawing illustrating a filing technique which is employed to shape an acrylic nail at its periphery.

After allowing a nail to fully set and become hard, one may wish to shape the nail further with a file or emery board. Since acrylic can be very hard when it is set, filing may take considerable effort and time. FIG. 5 is a drawing which shows a finger 51 having an acrylic fingernail 52 with a periphery 53 which is engaged by a file 54 operating in a reciprocating fashion indicated by directions 55. The artificial nail periphery is shaped by filing away hardened acrylic material from various places where its removal is desired. In addition, the top surface of the nail 52 may benefit from further dressing. It is sometimes desirable to buff smooth the top surface before applying fingernail polish. Acrylic which has set in air tends to leave a comparatively rough finish which does not look like the surface of a natural nail. Accordingly, surface buffing tends to improve the final look of an artificial nail. Buffing is also a difficult and time consuming step. Hard acrylic resists change and much effort is required to smooth it appropriately.

Preferred embodiments of the invention address issues relating to shape, uniformity and smoothness, among others. A highly specialized step is provided which encourages applied acrylic material to perform in a preferred manner. Similar to conventional techniques of applying acrylic, a two part mixture is prepared and brushed onto a nail and nail tip base. However, before the mixture is allowed to harden, a form is applied to the top surface of the gel. The form guides the acrylic material into a preferred shape and texture. In addition, the form urges the acrylic into a very uniform layer. After the acrylic hardens sufficiently, the form is removed from the hard acrylic and the acrylic remains bonded to the nail and the nail tip. FIG. 6 illustrates how a form is to be applied to the gelatinous acrylic. A finger 61 having been prepared with a nail and nail tip 62 is coated with a layer of acrylic material in a gel state 63. A form 64 substantially in the shape of a fingernail is pushed 65 onto the surface of the acrylic with mild pressure. The pressure tends to distribute the acrylic and encourage it to flow uniformly over the surface of the nail and nail tip base to which it has been applied. FIG. 7 shows a nail and nail tip 71 having a form 72 pushed thereon with gel acrylic material 73 therebetween. Still further pressure 74 causes the gel acrylic to flow 75 from regions of relative thickness to regions of relative thinness 76. A very uniform layer in FIG. 8 exists between a base 81 and the form 82. The form remains in contact with the gel acrylic until it hardens and sets in a solid state. The acrylic bonds aggressively to the nail and nail tip base while taking the shape and texture of the form where the acrylic is in contact with the form. Although the form tends to stay in place because of its intimate contact with the acrylic, it may be easily removed when pulled away from the hardened acrylic. This is due to the fact that the form is constructed of a plastic material which is not affected by hardening acrylic. Hardened acrylic does not bond to certain types of plastic. Smooth, nonporous plastic tends to be compatible with the acrylic in this manner. In some preferred versions, a tab or handle 83 may be affixed to the form. A tab which is easily gripped by two fingers may facilitate proper placement of the form. After the acrylic is set, the handle may be used to pull the form away therefrom. Since forms may be manufactured in a molding process, one will appreciate that may shapes and configurations are possible. Although the drawing FIG. 8 shows a tab at the tip of the form, the tab may be located at any part of the periphery or even on the top surface of the form.

A form of the invention may be constructed from plastic or other rigid material. A particularly important feature of the material from which the form is made includes its tendency to resist bonding to acrylic while in intimate contact therewith as the acrylic hardens. This allows the form to be easily removed from the artificial acrylic nail once it has cured.

The structure of a form of the invention may include a top surface and a bottom surface; the top surface being generally convex and the bottom surface being generally concave. The concave surface is the surface to be applied to the gel acrylic. Its shape may be complementary with respect to the shape of a desired fingernail. When used as a mold with gel acrylic, the form transfers its shape and texture by way of the concave surface to the hardened acrylic.

Although the periphery may be arbitrary in shape, preferred versions have a blunt end and a tip end. The radius of curvature of the concave surface may vary along the length of the form. The curvature at the blunt end may be preferably larger than the curvature at the tip end. The width at the blunt end tends to be wider that the width at the tip end. A smooth transition or taper is generally preferred from the blunt end to the tip end.

Some versions of forms may include a downwardly turned lip or edge which extends about the periphery. FIG. 9 illustrates a form 91 having such edge 92. A bottom surface 93 of the form is drawn as downwardly concave at the blunt end which is wider than the tip end 94.

The bottom surface of the form may alternatively include additional molding features. It is possible to fabricate the form such that an inverse relief pattern is impressed into the bottom concave surface. As the form is applied to acrylic material in a gel state, pressure causes the gel to occupy a void formed by the relief pattern. The hardened acrylic will maintain the pattern after the form is removed.

FIG. 10 shows a form 100 of the invention with a fanciful pattern arranged as a flower 101. The form of FIG. 10 can be used to create a fingernail having the complementary pattern thereon. Obviously, the invention is independent with respect to the design of any particular relief pattern. FIGS. 11 and 12 show forms 111 and 121 respectively having a heart pattern 112 and a simple stripe pattern 122. One will surely appreciate that forms of the invention will support a great plurality of designs which are too numerous to catalog here.

Forms of the invention are properly used in accordance with the following methods which are considered part of the invention. Thus, the invention additionally includes a method of forming artificial fingernails comprising a step of applying pressure to acrylic material in a gel state whereby the acrylic material tends to spread over a surface and form a substantially uniform layer.

By "substantially uniform layer" it is meant that the bulk of the nail forms the layer. A substantially uniform layer may be modified in accordance with the complement of the relief pattern described without deviating from the meaning intended.

Procedures and materials presently employed to form fingernails of acrylic materials are compatible with techniques and systems of the present invention. In addition, new acrylic compositions and materials such as those set forth in Applicant's co-pending application having a Ser. No. 08/703,224, also work well.

In a method of the invention, the steps generally taken to form fingernails can be modified by the addition of a single step of applying a form to freshly applied acrylic. The form may exert a pressure onto the top surface of the gel. The pressure encourages the gel to spread about as described above. This new step is applied while the acrylic is advancing in its polymerization process.

In brief, a fingernail base is prepared by attaching an artificial fingernail tip to a natural nail. A mixture of acrylic monomer and activator is prepared in a mixing station. The mixture in gel state is then applied to the top surface of the fingernail base, with an applicator such as a brush. A form of the invention is introduced and applied to the top of the curing gel in a fashion whereby the concave surface thereof comes into intimate contact with the gel acrylic. The gel then takes the shape of the form. The form is left in place for a period of time which is sufficient for the acrylic to harden and set in the shape imparted by the form. The form may then be removed from the acrylic by simply pulling away therefrom. The resulting nail may be dressed in the traditional way with minor filing, buffing, and polishing.

Although the form as it stands alone is clearly a unique and useful device, it is sometimes preferably used in combination with other materials. The group of materials, in combination together, form a unique kit which is considered part of the invention.

Accordingly, the invention includes a kit for forming artificial fingernails comprising an artificial fingernail forming apparatus comprising a rigid element having a top surface, a bottom surface, and a periphery, the bottom surface being concave and smooth whereby its shape is complementary to the shape of a human fingernail, the top surface being convex, and the periphery being arbitrary in shape. Kits may additionally be comprised of materials and objects such as: acrylic monomer, activator, mixing facilities, and applicator brushes. Still further, a kit may further comprise: a file, buffing implements, instructions, fingernail polish, among others.

Kits of the invention may include a group of pieces. Since a human hand has five fingers, kits may be arranged to have at least 10 pieces where each piece corresponds to a different fingernail. Since fingers and fingernails naturally vary in size, so might the pieces of the kit in direct correspondence an average hand. It is sometimes usefull to provide a 12 or 14 piece kit with an extra large or small element which allows persons with larger hands to use the same kit as persons with smaller hands.

Although the present invention has been described in considerable detail with clear and concise language and with reference to certain preferred versions thereof including the best mode anticipated by the inventor, other versions are possible. Therefore, the spirit and scope of the appended claims should not be limited by the description of the preferred versions contained therein.

Arthur A. Krause and George H. Carroll hereby claim:

1. An artificial fingernail forming apparatus comprising a rigid element having a top surface, a bottom surface, and a periphery, said bottom surface being concave and smooth whereby the shape of said bottom surface is complementary to the shape of the whole of a fingernail, said top surface being convex, and said periphery being arbitrary in shape.

2. An artificial fingernail shaping apparatus of claim 1, said bottom surface having structure which resists bonding to, while in contact with, an acrylic material subject to a polymerization reaction.

3. An artificial fingernail shaping apparatus of claim 1, additionally comprising a handle fixably attached to said rigid element whereby translational forces applied to said handle are transferred to said rigid element.

4. An artificial fingernail forming apparatus of claim 2, said rigid element additionally being comprised of a fanciful relief pattern formed into the concave surface.

5. An artificial fingernail shaping apparatus of claim 2, said periphery bounding said top and bottom surfaces and forming a downturned edge.

6. An artificial fingernail forming apparatus for shaping acrylic material comprising a rigid element having a top surface, a bottom surface, and a periphery, said bottom surface being concave and smooth whereby the shape of the bottom surface is complementary to the shape of the whole of a fingernail, said top surface being convex, and said periphery being arbitrary in shape.

7. An artificial fingernail forming apparatus for shaping acrylic material applied to a fingernail comprising a rigid element having a top surface, a bottom surface, and a periphery, said bottom surface being concave and smooth whereby the shape of the bottom surface is complementary to the shape of the whole of a fingernail, said top surface being convex, and said periphery being arbitrary in shape.

8. An artificial fingernail forming apparatus for shaping acrylic material applied to a fingernail comprising a rigid element having a top surface, a bottom surface, and a periphery, said bottom surface being concave and smooth whereby the shape of the bottom surface is complementary to the shape of the whole of a fingernail, said top surface being convex, and said periphery being arbitrary in shape, the apparatus being removable to leave thereon said fingernail a shape impressed into an acrylic material from said bottom surface.

9. A method of forming artificial fingernails comprising the step:

applying pressure to acrylic material in a gel state whereby the acrylic material tends to spread over a surface and form a predetermined shape.

10. A method of claim 9, said surface being a top surface of a fingernail.

11. A method of claim 9, said surface being a top surface of a fingernail in combination with a top surface of an artificial fingernail tip.

12. A method of claim 9, said application of pressure being affected by placing acrylic material between two elements being complementary shaped and pushing the elements toward each other.

13. A method of claim 12, a first element being a combination of a fingernail and an artificial fingernail tip and a second element being a prefabricated form of rigid material.

14. A method of claim 13, said second element being a plastic form having a first surface which is concave and a second surface which is convex, the concave surface being suitably shaped to resemble a fingernail.

15. A method of claim 14, said concave surface being smooth.

16. A method of claim 15, said second element being a plastic form having a first surface which is concave and a second surface which is convex, the concave surface being suitably shaped to resemble a fingernail and further including a relief or raised pattern having a fanciful design whereby said application of pressure causes acrylic material to be molded into the form of the relief or raised pattern.

17. A kit comprising, in part, an artificial fingernail forming apparatus comprising a rigid element having a top surface, a bottom surface, and a periphery, said bottom surface being concave and smooth whereby the shape of said bottom surface is complementary to the shape of the whole of a fingernail, said top surface being convex, and said periphery being arbitrary in shape.

18. A kit of claim 17 further comprising: acrylic monomer, activator, mixing facilities, applicator brush.

19. A kit of claim 18 further comprising: a file, buffing implements, instructions, and fingernail polish.

20. A kit of claim 19, additionally comprising a plurality of, artificial fingernail forming apparatus comprising a rigid element having a top surface, a bottom surface, and a periphery, said bottom surface being concave and smooth whereby the shape of said bottom surface is complementary to the shape of the whole of a fingernail, said top surface being convex, and said periphery being arbitrary in shape, each member of said plurality being slightly larger in size than the another such that a group is formed whereby the elements correspond to the average size of a ladies fingers.

* * * * *